US006073401A

United States Patent [19]

Iri et al.

[11] Patent Number: 6,073,401

[45] Date of Patent: Jun. 13, 2000

[54] BUILDING UNIT, UNIT BUILDING AND METHOD OF CONSTRUCTING THE SAME

[75] Inventors: Chika Iri; Katsunori Ohnishi, both of Tokyo, Japan

[73] Assignee: Sekisui Kagaku Kogyo Kabushiki Kaisha, Osaka, Japan

[21] Appl. No.: 09/023,919

[22] PCT Filed: Jun. 5, 1997

[86] PCT No.: PCT/JP97/01917

§ 371 Date: Feb. 13, 1998

§ 102(e) Date: Feb. 13, 1998

[87] PCT Pub. No.: WO97/48861

PCT Pub. Date: Dec. 24, 1997

[30] Foreign Application Priority Data

Jun. 18, 1996 [JP] Japan ..... 8/156656

[51] Int. Cl.[7] ..... E04H 1/00

[52] U.S. Cl. ..... 52/79.1; 52/79.9; 52/236.3; 52/236.9

[58] Field of Search ..... 52/79.1, 79.9, 52/236.3, 236.9

[56] References Cited

U.S. PATENT DOCUMENTS

| | | | |
|---|---|---|---|
| 3,971,172 | 7/1976 | Gentil | 52/79.9 X |
| 4,258,511 | 3/1981 | Strain | 52/79.1 |
| 4,441,286 | 4/1984 | Skvaril | 52/236.3 X |
| 4,644,708 | 2/1987 | Baudot et al. | 52/79.1 X |
| 5,044,134 | 9/1991 | Brockway | 52/79.1 |
| 5,412,913 | 5/1995 | Daniels et al. | 52/236.3 X |

*Primary Examiner*—Beth A. Aubrey
*Assistant Examiner*—Brian E. Glessner
*Attorney, Agent, or Firm*—Dvorak & Orum

[57] ABSTRACT

The present invention provides a building unit 12, wherein floor beams 22 which are structural framing members are connected to the lower end portions of columns 21 which are structural framing members, and ceiling panel 23 which is not a structural framing member is connected to the upper end portions of the columns 21.

7 Claims, 9 Drawing Sheets

(A)

(B)

(C)

(A)

(B)

(C)

BUILDING UNIT, UNIT BUILDING AND METHOD OF CONSTRUCTING THE SAME

FIELD OF THE INVENTION

The present invention relates to a building unit, a unit building and a construction method thereof.

BACKGROUND OF THE INVENTION

As a building unit which constitutes a unit building, there have conventionally been box-shaped framing structure having four columns, four floor beams and four ceiling beams as structural framing members (structural members forming the framing sharing horizontal and vertical forces)(Prior art A).

Another conventional building unit is proposed in Japanese Patent Application Laid-Open (JP-A) No. 57-201441, which has columns set on floor structure with no ceiling (Prior art B).

However, these conventional arts have problems as described below.

(Prior art A)

Ceiling height RH cannot be secured large. That is, as shown in FIG. 9, the transportation height limit Hx for transporting the factory manufactured building units to construction sites is fixed (3800 mm according to the present traffic regulations). Having the height of truck loading floor at the technically lowest limit, the maximum value for the unit height UH is 2940 mm, for example. When span L is desired to be about 6.3 m for the building unit of a two story house, the rational depth dimensions $B_1$ and $B_2$ for floor beams and ceiling beams which are constructed with steel members of limited thickness are approximately 240 mm. Taking the dimension above beam $b_1$ and the dimension below beam $b_2$ at 30 mm and 60 mm, respectively, the ceiling height RH is $UH-(B_1+b_1+B_2+b_2)=2370$ mm as the limit.

(Prior art B)

(1) Since a building unit is not provided with ceiling beams, ceiling cannot be provided at the factory manufacturing stage, and building interior structure such as partitions cannot be completed. Therefore, the factory manufacturing efficiency cannot be improved (FIG. 8(A)).

(2) When a building unit is stored at store yard, the cover sheet which is provided around the building unit droops down due to the rain water deposited on top thereof (FIG. 8(B)).

(3) When a building unit is hoisted up for such as installation, there is a risk that the whole shape can be deformed (FIG. 8(C)).

In order to avoid the problem described in above (2), it is necessary to temporarily provide support members in-between the upper end portions of columns of the building units, as disclosed in Japanese Patent Application Publication (JP-B) No. 3-30659.

DISCLOSURE OF THE INVENTION

An object of the present invention is to secure ceiling height as much as possible, while enabling the installation of ceiling portion into a building unit at the factory manufacturing stage.

The present invention provides a building unit which is a framing structure comprising a plurality of structural framing members connected to each other, wherein floor beams which are structural members are connected to the lower end portions of the columns which are structural framing members, and ceiling support members which are not structural framing members are connected to the upper end portions of the columns.

BEST PRACTICAL MODES OF THE INVENTION

Figure 1:
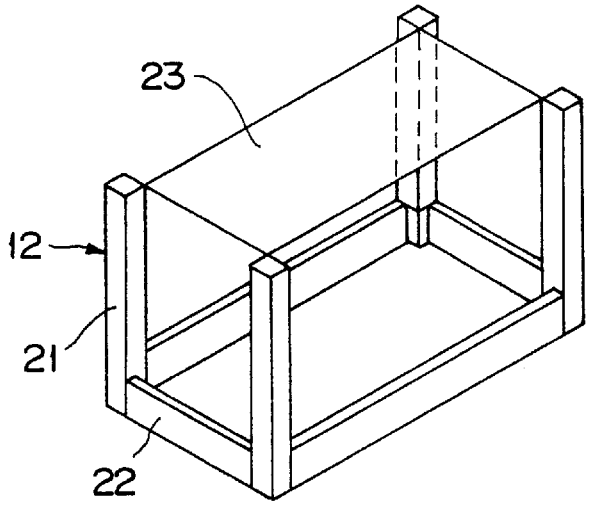
FIG. 1A is a schematic drawing of an individual building unit of the invention.
FIG. 1B is a schematic drawing of two individual building units above the floor beams of the building unit structure.
FIG. 1C is a schematic drawing of the FIG. 1B components assembled into a unit building of the present invention.
Figure 1:
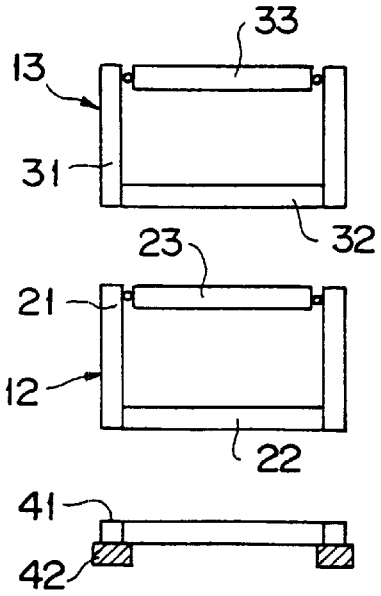
Figure 1:
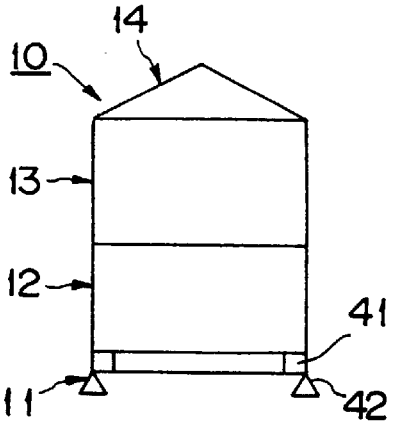

Unit building 10 is assembled, as shown in FIG. 1, by setting lower story building unit 12 on top of footing 11, setting upper story building unit 13 on top of the lower story building unit 12, and setting roof structure 14 on top of the upper story building unit 13.

(Lower Story Building Unit 12) (FIGS. 1–4)

Figure 2:
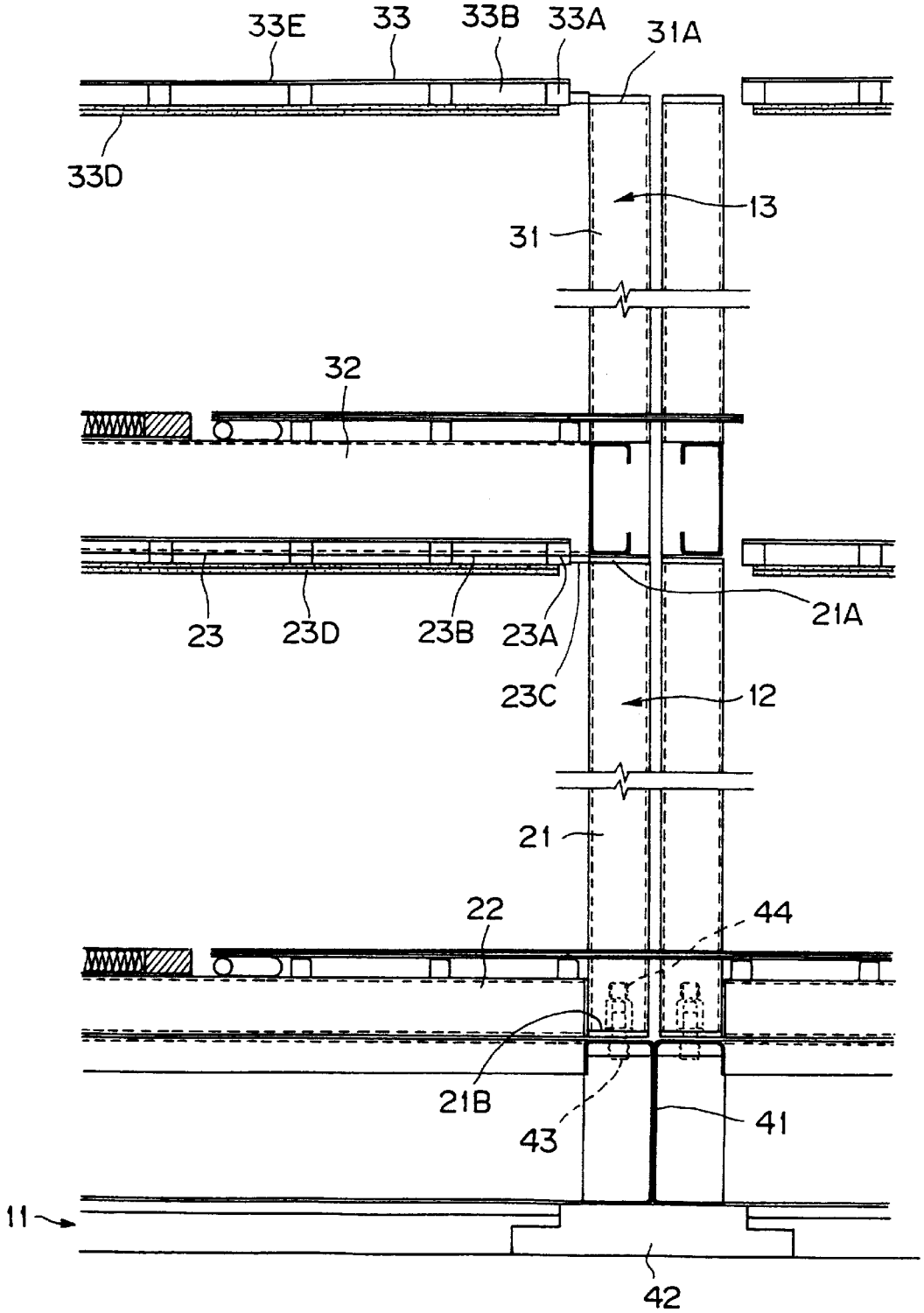
FIG. 2 is a schematic drawing showing a unit building according to the first embodiment of the present invention.

The lower story building unit 12 is a frame structure, as shown in FIGS. 1 and 2, which comprises four square-shaped steel pipe columns 21, four rolled steel floor beams 22 and ceiling panel 23 (ceiling support members) connected to each other in box shape.

The columns 21 and the floor beams 22 are structural framing members which form the framework of the building unit 12 sharing the horizontal and vertical forces. The ceiling panel 23 is not a framing member. That is, the building unit 12 is assembled by rigidly connecting the floor beams 22 respectively by welding or the like to the lower end portions of the columns 21, and pin-connecting the ceiling panel 23 to the upper end portions of columns 21 respectively by fixing pieces 23C described later.

Figure 3:
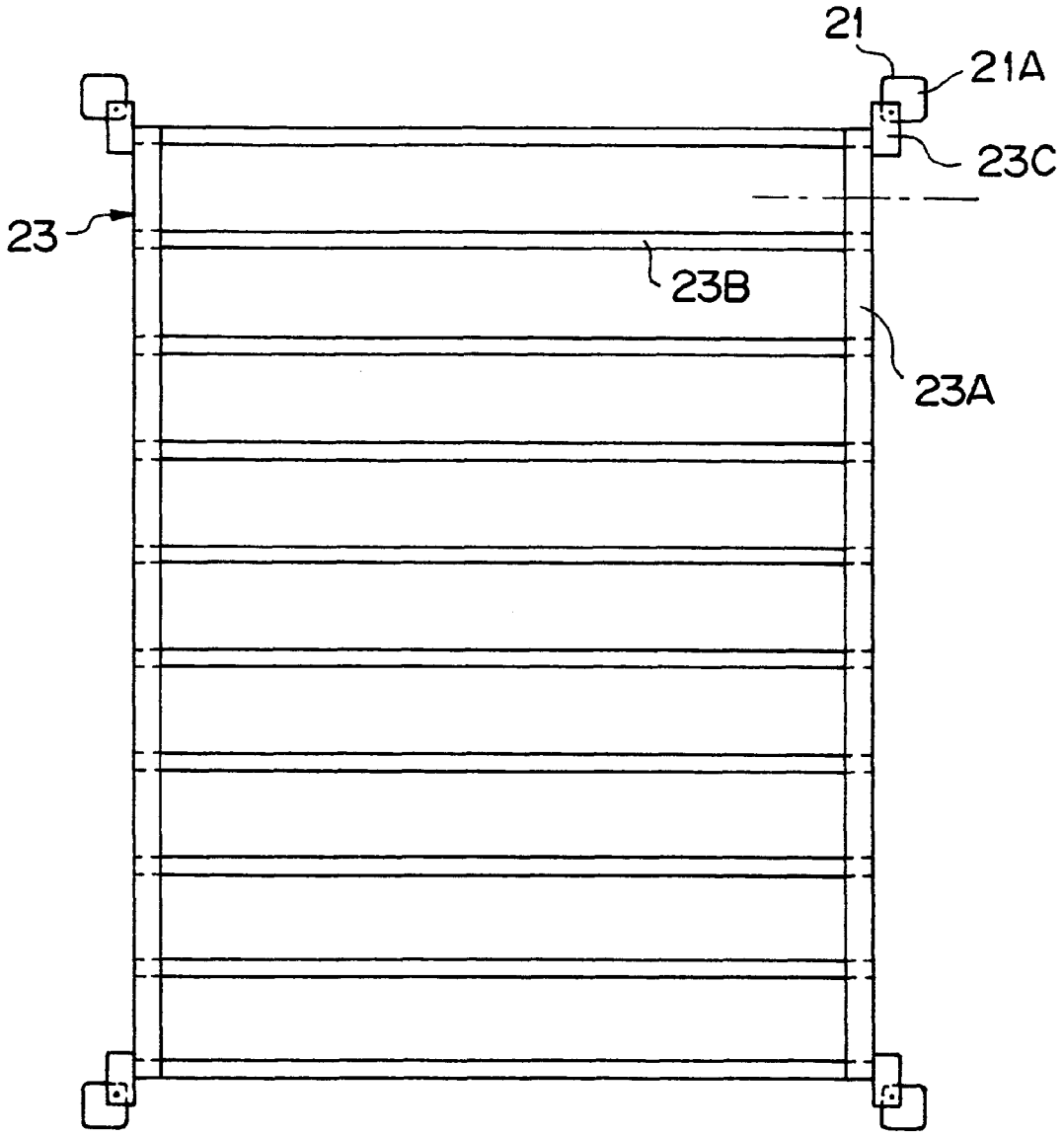
FIG. 3 is a schematic drawing showing ceiling support members.
Figure 4:
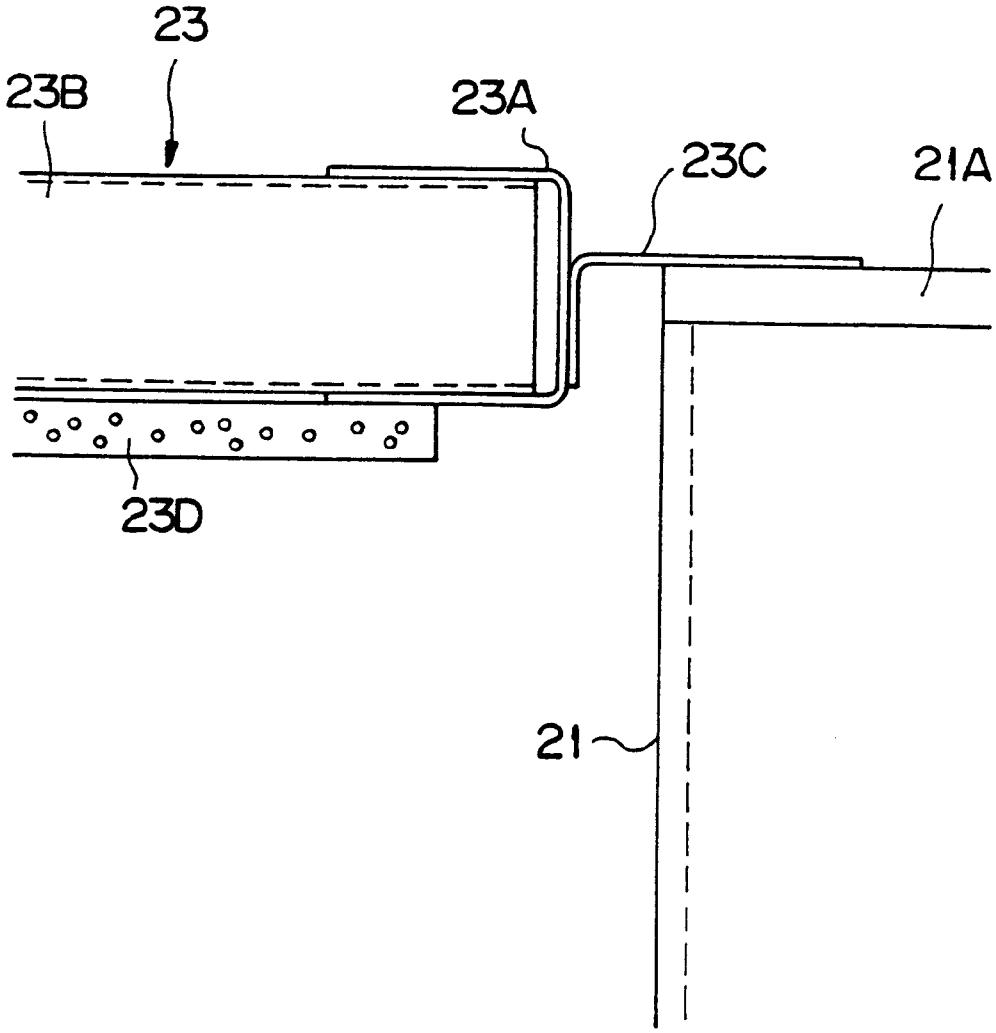
FIG. 4 is a schematic drawing showing the attachment of the ceiling support members.

At this time, the ceiling panel 23, as shown in FIGS. 3 and 4, is consisted of horizontal members 23A and vertical members 23B, and is attached to the upper endplates 21A of the columns 21 by rivets or the like via fixing pieces 23C (fixing parts) connected to the horizontal members 23A. Ceiling sub-base 23D is attached to the underside of the ceiling panel 23.

(Upper story building unit 13) (FIGS. 1 and 2)

The upper story building unit 13 is substantially the same as the lower story building unit 12, and is a frame structure, as shown in FIG. 2, which comprises four square-shaped steel pipe columns 31, four rolled steel floor beams 32 and ceiling panel 33 (ceiling support members) connected to each other in box shape.

The columns 31 and the floor beams 32 are structural framing members which form the framework of the building unit 13 sharing the horizontal and vertical forces. The ceiling panel 33 is not a framing member. That is, the building unit 13 is assembled by rigidly connecting the floor beams 32 respectively by welding or the like to the lower end portions of the columns 31, and pin-connecting the ceiling panel 33 to the upper end portions of columns 31 respectively by fixing pieces (not shown).

At this time, the ceiling panel 33, similarly to the ceiling panel 23, is consisted of horizontal members 33A and vertical members 33B, and is attached to the upper endplates 31A of the columns 31 by rivets or the like via fixing pieces (not shown) connected to the horizontal member 33A. Ceiling sub-base 33D is attached to the underside of the ceiling panel 33 and scaffolding 33E is attached to the upper side of the ceiling panel 33.

A unit building 10 is assembled by the following steps (1) to (5):

(1) Rolled steel footing beams 41 are laid on the ground. The footing beams 41 are fixed to footings 42 made of precast concrete or poured-in-place concrete by use of anchoring bolts and the like (FIG. 1).

(2) The lower endplates 21B of the columns 21 of the lower story building unit 12 are rigidly connected to the footing beams 41 by high tension bolts 43 and nuts 44 (FIGS. 1 and 2).

Figure 6:
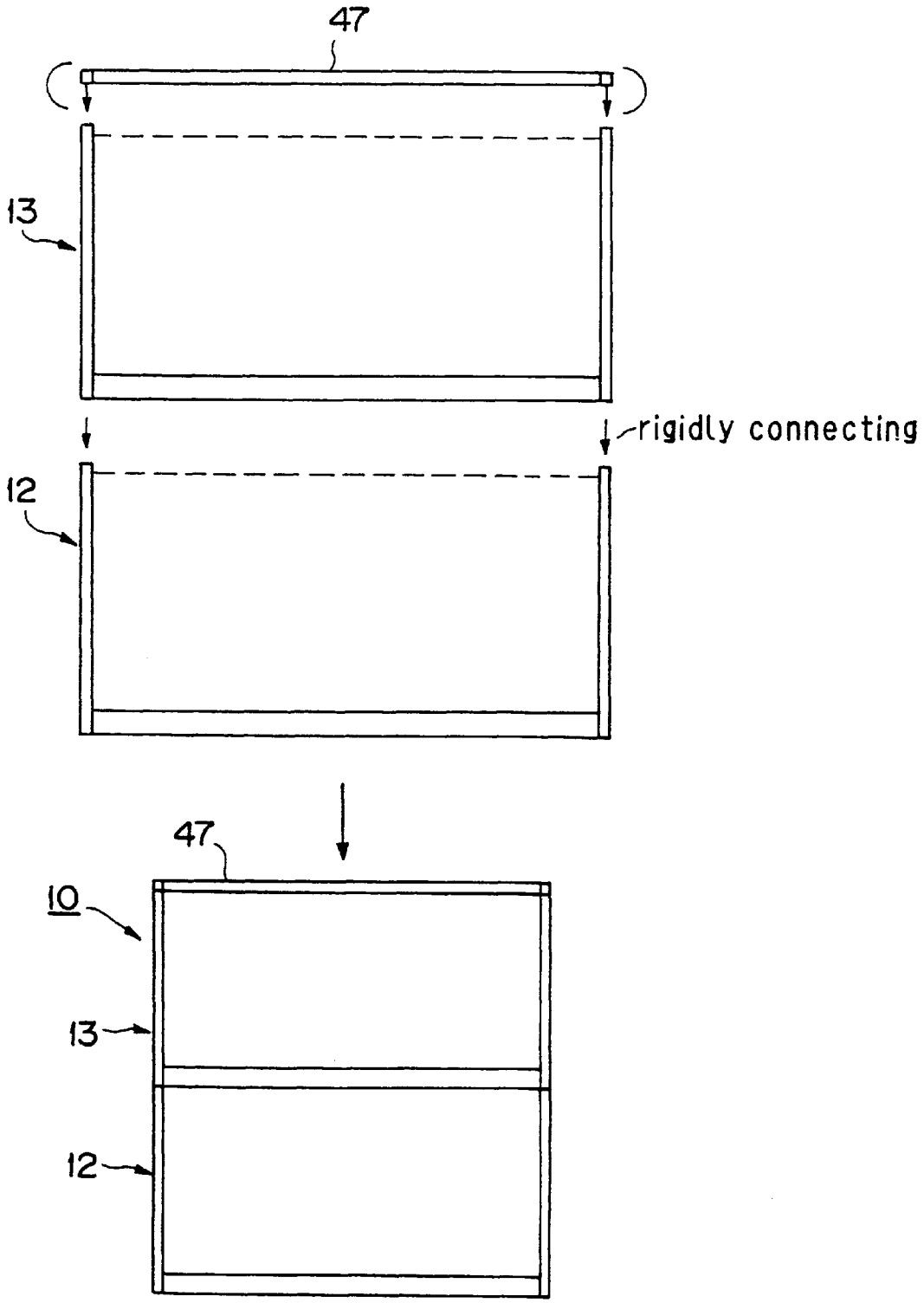
FIG. 6 is a schematic drawing showing the connection system of a lower story building unit and an upper story building unit.
Figure 7:
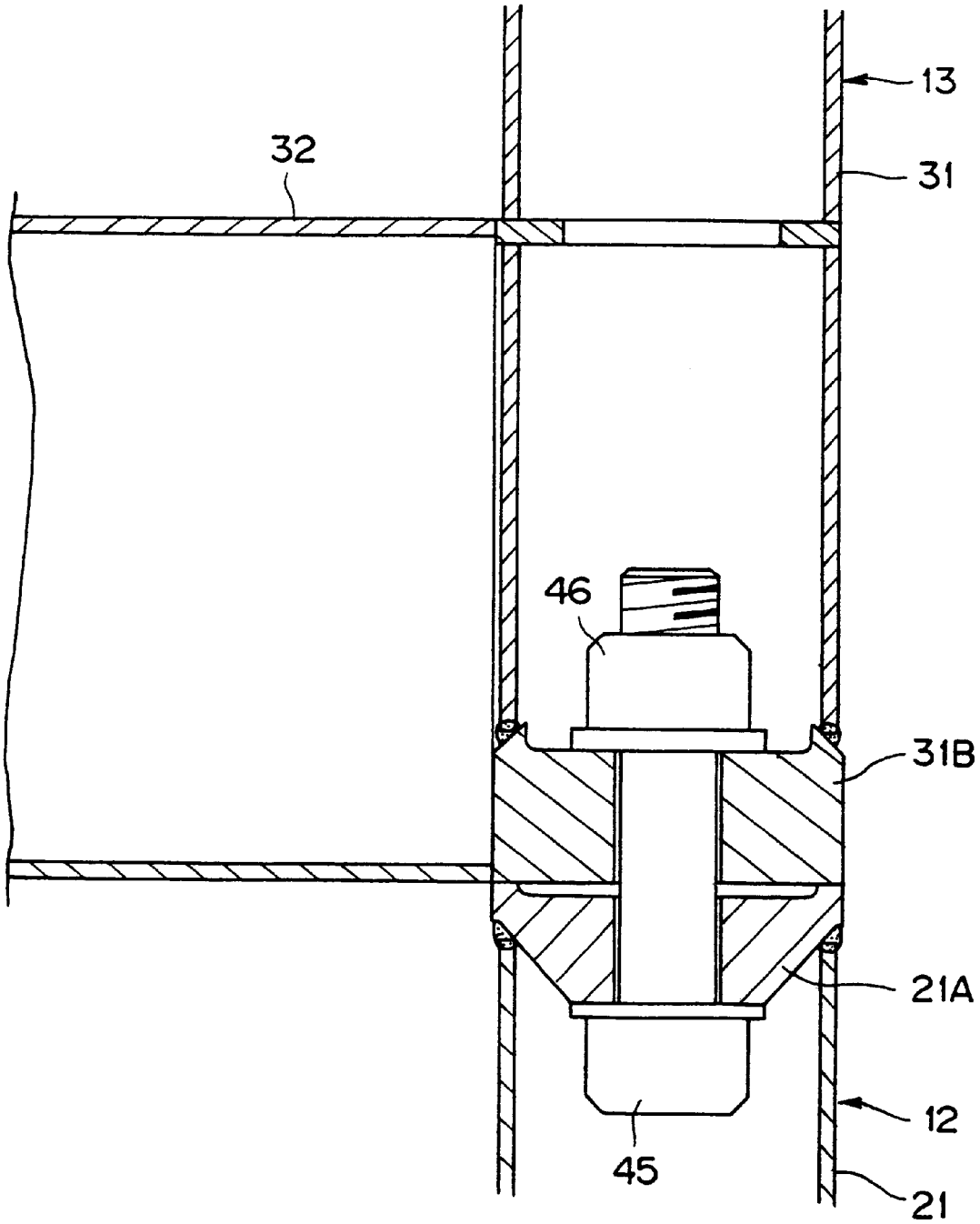
FIG. 7 is a schematic drawing showing the crucial details of FIG. 6.
Figure 8:
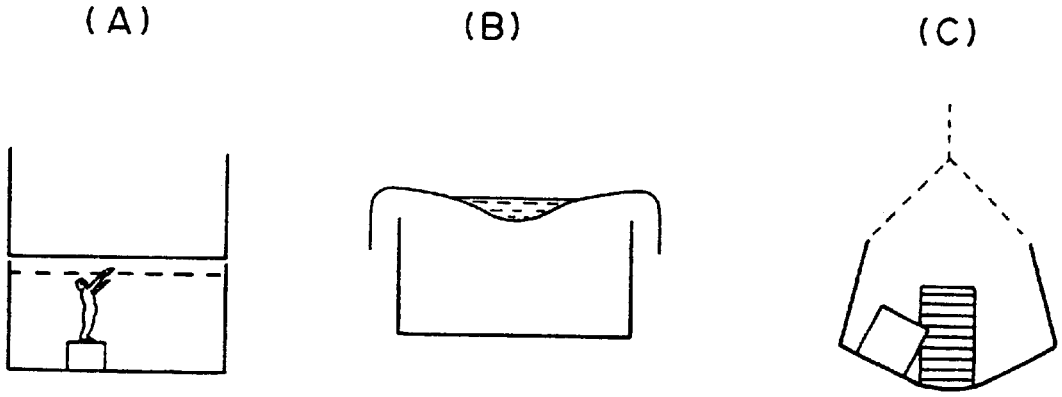
FIG. 8A is a schematic drawing emphasizing unit building construction at the factory.
FIG. 8B is a schematic representing a drooping problem not found with the present invention.
FIG. 8C is a schematic representing a deformation problem not found with the present invention.
Figure 9:
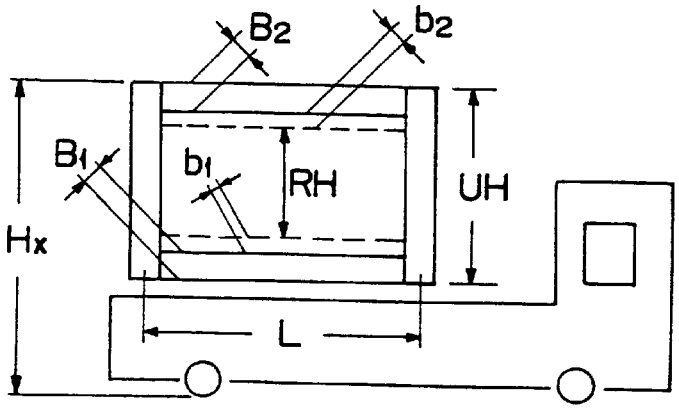
FIG. 9 is a schematic drawing showing the transportation of a building unit.

(3) The upper story building unit 13 is set on top of the lower story building unit 12 (FIG. 6), and the lower endplates 31B of the column 31 of the upper story building unit 13 are rigidly connected to the upper endplates 21A of the columns 21 of the lower story building unit 12 by high tension bolts 45 and nuts 46 (FIGS. 6 and 7).

(4) Reinforcing beams 47 (or roof structure 14) are set on top of the columns 31 of the upper story building unit 13, and the reinforcing beams 47 (or roof structure 14) are rigidly connected to the upper endplates 31A of the columns 31 of the upper story building unit 13 by high tension bolts and the like (FIG. 6).

Figure 5:
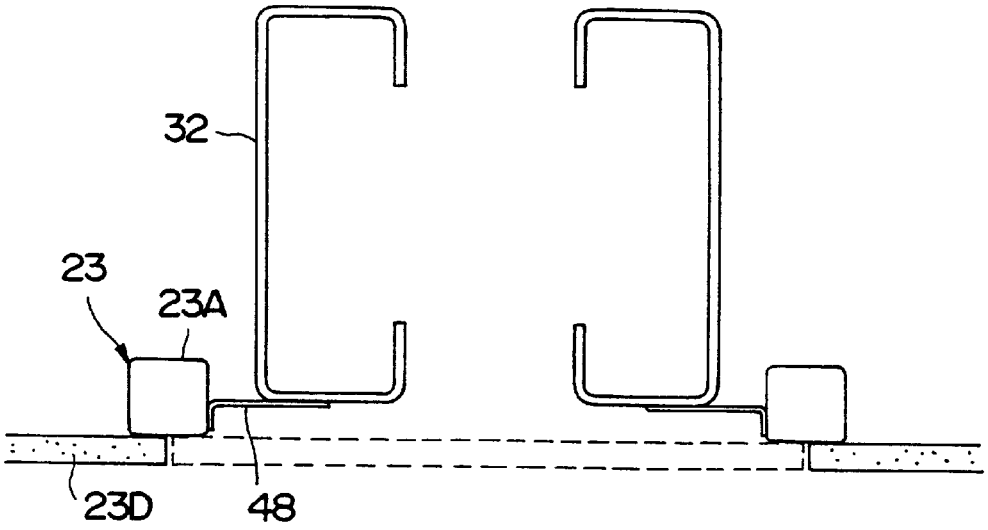
FIG. 5A is a schematic drawing showing the horizontal ceiling members connected to the floor beams of an upper unit.
FIG. 5B shows in detail the connecting parts for connecting the components of FIG. 5A.
FIG. 5C is a schematic drawing emphasizing the adjustability of the ceiling heights between the floor beam and the ceiling panel.
Figure 5:
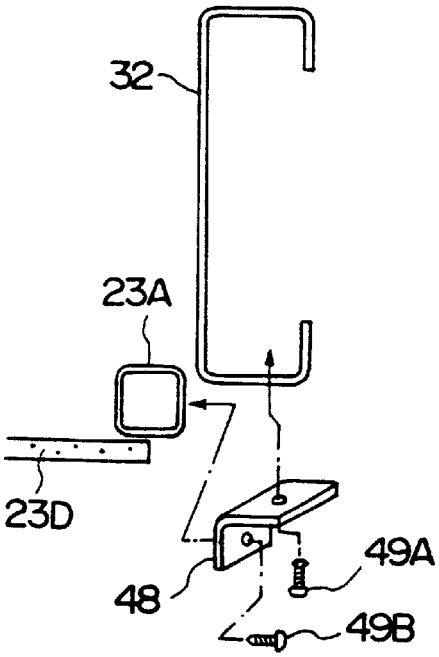
Figure 5:
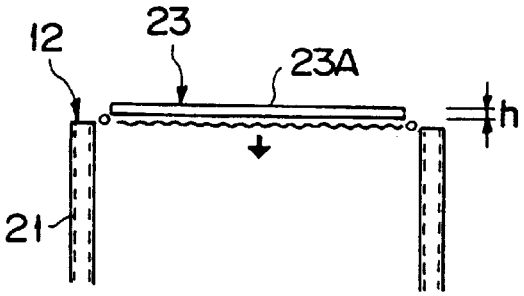

(5) At this time, the horizontal members 23A of the ceiling panel 23 of the lower story building unit 12 (horizontal members 33A of the ceiling panel 33 of the upper story building unit 13) are disposed along the floor beams 32 (reinforcing beams 47 or roof structure 14) of the upper story building unit 13, and the horizontal members 23A are connected to the floor beams 32 of the upper story building unit 13 by the connecting parts 48 at a plurality of positions in a longitudinal direction thereof (FIG. 5). The connecting parts 48 are fixed to the floor beams 32 with fixing screws 49A as well as fixed to the horizontal members 23A of the ceiling panel 23 with the fixing screws 49B. In the unit building 10, by adjusting the fixing positions of the ceiling panel 23 to the connecting parts 48, the ceiling panels 23 of the neighboring building units 12 and the ceiling heights thereof can be adjusted. In addition, the ceiling panel 23 is supported by temporary supports or the like provided within the lower story building unit 12 until being connected to the floor beams 32 of the upper story building unit 13 by the connecting parts 48.

Effects of the present embodiments will be explained hereinafter.

(1) The ceiling portion of the building unit 12 is constructed with the ceiling panel 23 which is not a structural framing member, so that the ceiling portion has no framing member. Since the ceiling panel 23 is not a structural framing member, the depth dimension $B_2$ thereof can be made small, and as a result, the ceiling height RH can be secured large. Moreover, under the condition that the unit height UH of the building unit 12 is kept within a certain range, depth dimension $B_1$ of the floor beam 32 can be made large while keeping the ceiling height RH large, thereby considerably improving the floor beam strength. The floor beam strength is directly proportional to the cube of the depth dimension $B_1$ of the floor beam.

(2) Since the ceiling panel 23 is provided for the ceiling portion of the building unit 12, the ceiling portion can be assembled at the factory manufacturing stage and the building interior structure such as partitions can be completed, with the result that high efficiency of factory manufacturing can be attained. Moreover, the ceiling panel 23 supports the cover sheet when the building unit 12 is stored so that the drooping problem can be avoided. Furthermore, even if the building unit 12 is hoisted up for installation and the like, the deformation of the total shape of the building can be prevented.

(3) The ceiling support members comprise the ceiling panel 23, and the horizontal members 23A of the ceiling panel 23 are connected to the columns 21 via the fixing pieces 23C. Thus, the ceiling portion of the building unit 12 can be simplified with regard to the assembly structure and assembly work.

(4) By connecting the structural framing members (columns 31 or floor beams 32) of the upper story building unit 13 to the upper end portions of columns 21 of the building unit 12 which comprises columns 21 and floor beams 22 as structural framing members, rigid steel framing structure can be constructed with the building units having no ceiling beams (structural framing members). In addition, under the condition that the unit height UH of the building unit 12 is kept within a certain range, depth dimension $B_1$ of the floor beam 32 can be made large, while securing the ceiling height RH large, thereby considerably improving the floor beam strength. For example, considering the depth dimension $B_1$ of the floor beam to be equal to the sum (2a) of the conventional depth dimension (a) of the floor beam of the upper story building unit and the depth dimension (a) of the ceiling beam of the lower story building unit, the floor beam strength of depth dimension $B_1$=2a is $8a^3$, that is four times the strength $2a^3$ on the occasion that the floor beam and the ceiling beam of the conventional depth dimension (a) are piled up.

(5) The horizontal members of the ceiling panel 23 are disposed along the floor beams 32 of the upper story building unit 13, and the horizontal members 23A are connected to the floor beams 32 of the upper story building unit 13 by the connecting parts 48 at a plurality of positions in a longitudinal direction thereof, so that even if the depth dimension h of the horizontal member 23A is made small, the deflection of the horizontal member 23A can be minimized. That is, the panel thickness of the ceiling panel 23 can be made thin, and as a result, the large ceiling height can be achieved.

(6) By connecting the lower end portions of the columns 21 or the floor beams 22 of the building unit 12 which comprises columns 21 and floor beams 22 as structural framing members to the footing beams 41, and connecting the structural framing members (columns 31 or floor beams 32) of the upper story building unit 13 to the upper end portions of the columns 21 of the building unit 12, rigid steel framing structure can be constructed with the building units 12 having no ceiling beams (structural framing members). In addition, the floor beams 22 (structural framing members) of the building unit 12 can be reinforced by footing beams 41 with result that the depth dimension of the floor beam 22 can be made small compared with the standard one and the large ceiling height can be achieved.

Now, modification of the present embodiment is explained, wherein the lower endplates 31B of the columns 31 of the upper story building unit 13 are rigidly connected by bolts to the upper endplates 21A of the columns 21 of the lower story building unit 12.

Figure 10:
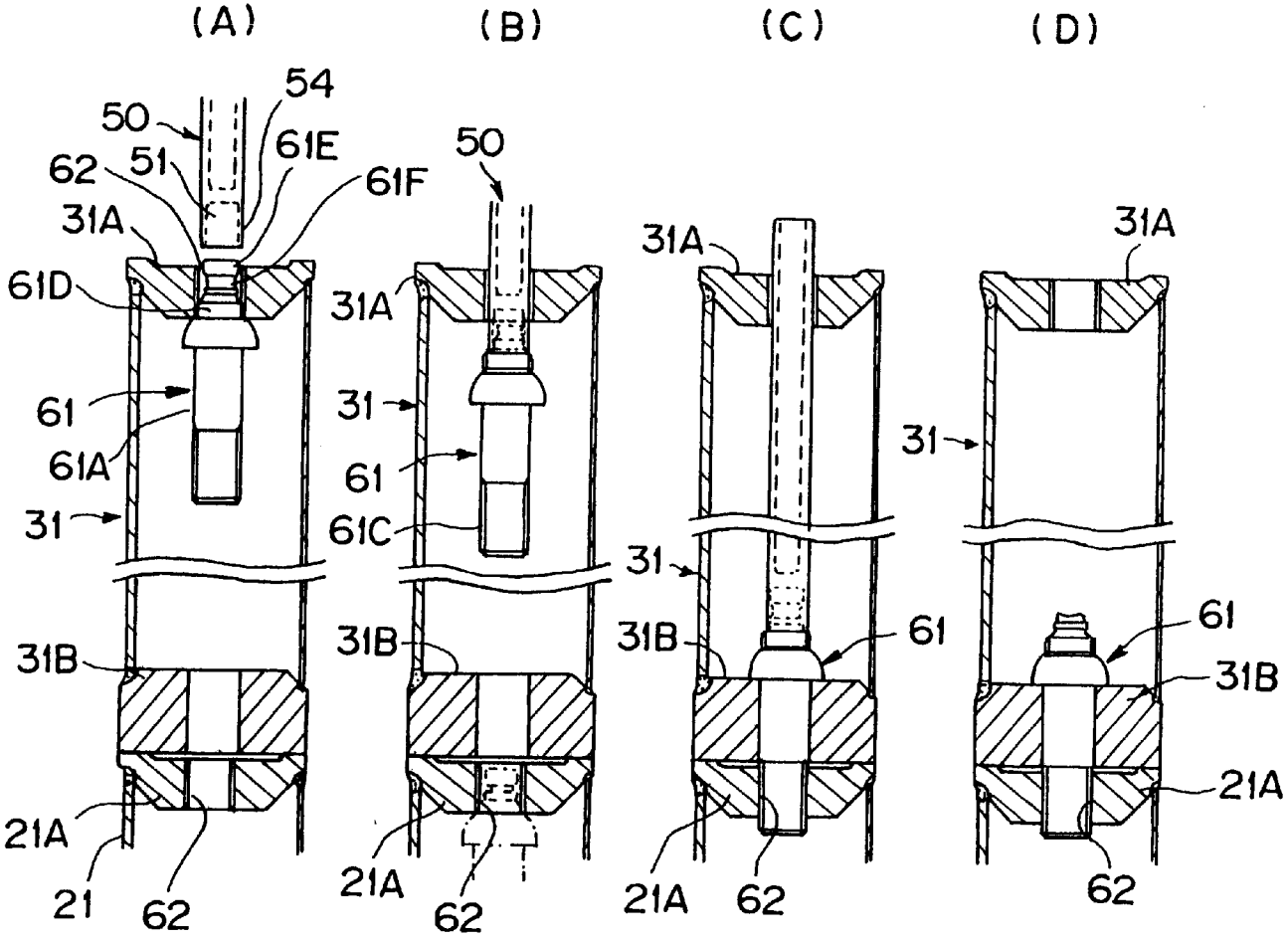
FIG. 10A is a first fixing stage of the fixing process of the columns of a building unit by manipulating a tool upon factory installed anchoring bolts.
FIG. 10B is a second stage of the fixing process.
FIG. 10C is a third stage of the fixing process.
FIG. 10D shows the final stage with the column fixed in place.

Specifically, fixing process of columns 21 and 31 by bolts 61 using fixing tool 50 will be explained (FIG. 10).

(1) Female screw portions 62 are provided at the upper endplate 21A of the columns 21 in the lower story building unit 12 fixed on the footing beams 41.

(2) Bolt 61 is preliminarily set at the factory manufacturing stage to the female screw portion 62 provided at the upper endplate 31A of the column 31 in the upper story building unit 13. At this time, the upper end portion of the bolt 61 is mounted on the upper endplate 31A so as to protrude from the upper endplate 31A of the column 31 (FIG. 10(A)).

(3) The sleeve 51 of the tightening tool 50 is engaged with the tool gripping portion 61E of the bolt 61 described in above (2). Before this sleeve 51 reaches the tool gripping portion 61E, the end-tip portion 54 of the tightening tool 50 is inserted around the bolt 61, widening elastically around the bolt 61, reaches or passes through the weakest engaging portion 61F closer to bolt main body 61A from the tool gripping portion 61E, and holds the tool gripping portion 61E tightly.

(4) By rotating the sleeve 51 with the handle of the tightening tool 50, sub-male screw portion 61D of the bolt 61 is screwed off from the female screw portion 62 of the upper endplate 31A of the upper story building unit 13, and then the bolt 61 which is held engaged with the end-tip portion 54 is inserted into the column 31 (FIG. 10(B)).

(5) Using the tightening tool 50, main male screw portion 61C of the bolt 61 which has been inserted into the column 31 is screwed onto the female screw portion 62 of the upper endplate 21A of the lower story building unit 12 through the bolt insert hole of the lower endplate 31B of the upper story building unit 13, and the column 31 (lower endplate 31B) of the upper story building unit 13 is fixed to the column 21 (upper endplate 21A) of the lower story building unit 12 (FIG. 10(C)).

During the screwing process of the tightening tool 50 of the above (5), the weakest engaging portion 61F of the bolt 61 breaks when a predetermined torque is attained (FIG. 10(D)). Thus, the bolt 61 is screwed onto the female screw portion 62 with a predetermined torque.

(6) The tightening tool 50 is pulled out of the column 31. At this time, the end-tip portion 54 of the tightening tool 50 can be taken out of the column 31 by engaging with the weakest engaging portion 61F of the bolt 61 and tightly holding the tool gripping portion 61E which has been cut off from the bolt main body 61A due to breaking of the bolt 61. By the above (5), once the screwing of the bolt 61 onto the female screw portion 62 is started, unless the weakest engaging portion 61F of the bolt 61 is broken by screwing using the tightening tool 50, the end-tip portion 54 of the tightening tool 50 is held engaged with the tool gripping portion 61E which is integrated with the bolt main body 61A and cannot be taken out from the column 31.

The tightening tool 50 is prepared for the next use by removing by hand or the like the tool gripping portion 61E which is tightly held by the end-tip portion 54 after the bolt breaking described above (6).

In addition, connecting method of the building units by use of the tightening tool 50 and the bolts 61 according to this modification may be applied to the case where the lower endplates 21B of the columns 21 of the lower story building unit 12 are rigidly connected to the footing beams 41 by bolts.

Effects of this modification will be explained hereinafter.

(1) Bolt 61 is preliminarily mounted on the female screw portion 62 of the upper endplate 31A of the building unit 13 in a protruding state and plugs up the female screw portion 62 of the upper endplate 31A. Therefore, as long as the bolt 61 is mounted on the upper endplate 31A, the upper story building unit or the roof structure members cannot be assembled on the building unit 13, so that the construction cannot be proceeded. That is, when the upper story building unit or the roof structure members are assembled on top of the building unit 13, checking are always done for the fixing of the columns 31 of the building unit 13 to the lower story building unit 12.

(2) Bolt 61 which has been inserted into the column 31 is screwed onto the female screw portion 62 provided at the lower story building unit 12. Therefore, comparing to the case where the bolt is provided at the lower building unit 12 onto which the nut inserted into the column 31 is screwed, parts to be used become compact. That is, concerning the screw type receptor provided at the lower story building unit 12, the screw type receptor according to the present invention can be constituted by only providing the female screw portion 62 at the upper endplate 21A of the column 21, and thus, is more compact than the one comprising the bolt at the female screw portion 62 provided at the upper endplate 21A. Moreover, concerning the screw type tightening part to be inserted into the column 31, the screw type tightening part according to the present invention can be constituted by the compact bolt 61 having small volume (small diameter, short height) head 61B on top of the male screw portion 61C, and is more compact compared to the one comprising large volume (large diameter, tall height) nut.

(3) In the process where the bolt 61 is screwed onto the female screw portion 62 of the lower story building unit 12, when the tightening tool 50 reaches a predetermined torque, the weakest engaging portion 61F of the bolt 61 breaks. Thus, even though the tightening tool 50 is handled from outside of the column, the bolt 61 can be screwed with the desired torque, and the column 31 of the building unit 13 can be securely fixed to the lower story building unit 12.

(4) The tightening tool 50 can be attached around the bolt 61 only in one direction from the tool gripping portion 61E toward the bolt main body 61A, and engages with the weakest engaging portion 61F provided closer to the bolt main body 61A, tightly gripping the tool gripping portion 61E. Therefore, once the tightening tool 50 is attached to the bolt 61, there is no chance for the gripping portion 61E of the bolt 61 to drop off the tightening tool 50, thereby ensuring that the tightening tool 50 inserts the bolt 61 into the column 31 and screw the bolt 61 onto the female screw portion 62 of the lower story building unit 12.

(5) After the weakest engaging portion 61F of the bolt 61 breaks with a predetermined torque by the screwing operation of the tightening tool 50, the tightening tool 50 is taken out of the column 31 holding only the tool gripping portion 61E separated from the bolt main body 61A of the bolt 61. Therefore, the tightening tool 50 cannot be pulled out until the bolt 61 is completely tightened up with a predetermined torque. Thus, the completion of tightening the bolt 61 with a predetermined torque can be easily confirmed outside the column 31 by visually checking that the tightening tool 50 which has been taken out holds only the tool gripping portion 61E and not the bolt main body 61A.

Although the embodiments of the present invention has been explained in details in the above, embodiments of the present invention are not limited thereto. Accordingly, all changes which come within the range of the meaning of the present invention are intended to be embraced therein. For example, the building unit according to the present invention may be directly connected to the footing without having footing beams therebetween. Furthermore, the upper story building unit connected to the upper end portions of the columns of the building unit is not limited to the building unit without ceiling beams, and may be a building unit with ceiling beams.

INDUSTRIAL USABILITY

According to the present invention, as described above, large dimension for ceiling height can be attained while making it possible to assemble ceiling to a building unit at the factory manufacturing stage.

What is claimed is:

1. A building unit which is a framing structure, comprising:

a generally rectangularly configured structure comprised of steel footing beams for fixating to concrete footings;

a plurality of assembled structural framing members for carrying all load bearing forces experienced by said building unit, said standard framing members comprising a plurality of open columns and an equal plurality of floor beams connected to the columns, said columns each having respective upper and lower ends, upper and lower end portions delineating said ends, and corresponding upper and lower endplates attached to said end portions, each of said endplates closings said upper and lower end portions and having a centralized hole therein, wherein the floor beams are connected to at least one of said steel footing beams and said columns, wherein the floor beams connect with said columns at said endplates and said floor beams connect with said columns at a respective lower ends thereof; and ceiling members which are non-structural framing members, said ceiling members for supporting ceiling panels thereon, said ceiling members fixed to said columns near said upper ends thereof, said ceiling members hanging from each of said columns such that the load bearing forces which are transferred through said structural framing members are not transferred into said ceiling members.

2. The building unit according to claim 1, wherein said ceiling members comprise horizontal members connected to said column.

3. A unit building using the building units of claim 1 comprising:

at least one lower building unit comprising a plurality of columns and an equal plurality of floor beams, said floor beams connected to columns, said columns of said building unit each having respective upper and lower end portions, wherein the floor beams are connected to the respective lower end portions of the columns and ceiling support members which are not structural framing members, wherein a second plurality of said same structural framing members are constructed into an upper building unit, which said upper building unit is connected to the upper end portions of columns of the lower building unit with said means for connecting, and wherein said ceiling support members are connected to a column by use of fixing parts.

4. The unit building according to claim 3, wherein the horizontal members of said ceiling panel are disposed along the floor beams of the upper story building unit, and said horizontal members are connected to the floor beams of the upper story building unit at a plurality of positions in a longitudinal direction thereof.

5. A method of constructing a unit building, comprising the steps of:

providing and setting a plurality of footing beams on the ground;

assembling a lower building unit which is comprised of structural framing members, said framing members comprising a plurality of open columns and an equal plurality of floor beams connected to said columns, wherein ceiling members which are non-structural framing members are fixed to said columns near said upper ends thereof, said ceiling members hanging from said columns such that load bearing forces experienced by said building unit are not transferred therein, said floor beams connected to the respective lower ends of the columns, said columns each having respective upper and lower ends, upper and lower end portions delimiting said ends and corresponding endplates attached to the upper and lower end portions, each of said endplates closing said upper and lower end portions and having an identical centralized connecting hole therein;

connecting the endplates of each of the lower end portions of said columns to said footing beams thereby forming a lower building unit;

assembling an upper building unit which is comprised of another plurality of structural framing members, said other framing members comprising a plurality of columns and an equal plurality of floor beams connected to said columns at the lower ends of said columns, said columns each having respective upper and lower ends, upper and lower end portions delineating said ends and endplates attached and closing the upper and lower end portions of each column, said end plates each having a centralized connecting hole therein; and connecting the structural framing members of the upper building unit to the upper end portions of columns of the lower building unit.

6. The building unit of claim 1, further including means for connecting said column bottom endplates to said footing beams, said means comprising a female screw portion inserted into and secured within each said hole of said endplates and a respective anchoring bolt threadingly engaged within each said female screw portion, said anchoring bolt having a threaded male screw portion and a sub-male screw portion, said sub-male screw portion in threading engagement within said female screw portion, wherein said anchoring bolts are pre-assembled within said open column prior to connection of said framing members, and wherein said anchoring bolt includes a means for connecting said columns to said footing beams to a predetermined torque.

7. A method of constructing a unit building, comprising the steps of:

providing and setting a plurality of footing beams on the ground;

assembling a lower building unit which is comprised of structural framing members, said framing members comprising a plurality of open columns and an equal plurality of floor beams connected to said columns, wherein ceiling members which are non-structural framing members are fixed to said columns near said upper ends thereof, said ceiling members hanging from said columns such that load bearing forces experienced by said building unit are not transferred therein, said floor beams connected to the respective lower ends of the columns, said columns each having respective upper and lower ends, upper and lower end portions delimiting said ends and corresponding endplates attached to the upper and lower end portions, each of said endplates closing said upper and lower end portions and having an identical centralized connecting hole therein;

connecting the endplates of each of the lower end portions of said columns to said footing beams thereby forming a lower building unit;

assembling an upper building unit which is comprised of another plurality of structural framing members, said other framing members comprising a plurality of columns and an equal plurality of floor beams connected to said columns at the lower ends of said columns, said columns each having respective upper and lower ends, upper and lower end portions delineating said ends and endplates attached and closing the upper and lower end portions of each column, said end plates each having a centralized connecting hole therein;

connecting the structural framing members of the upper building unit to the upper end portions of columns of the lower building unit;

inserting female screw portions into each of said connecting holes of said upper endplates on said columns of said upper and lower building units;

pre-inserting column connecting bolts into each of said female screw portions of said upper building unit;

aligning said connecting holes of the lower portions of said columns of said upper building unit with said female screw portions of the upper portions of said columns of said lower building unit;

inserting said connecting bolts into the female screw portions of the lower building unit columns by using a tightening tool, wherein said tightening tool screws said connecting bolts from said female screw portions of said upper building units through said connecting holes of said lower portion endplates on said upper building unit columns, into said female screw portions of the lower building unit, thereby rigidly fixing the columns of the upper building unit to the columns of the lower building unit.

* * * * *